US010443253B2

(12) United States Patent
Taylor

(10) Patent No.: US 10,443,253 B2
(45) Date of Patent: Oct. 15, 2019

(54) SAFETY SCREEN COMPRISING A FIXING MEANS

(71) Applicant: ISCHEBECK TITAN LIMITED, Burton upon Trent, Staffordshire (GB)

(72) Inventor: Mark Taylor, Burton upon Trent (GB)

(73) Assignee: ISCHEBECK TITAN LIMITED, Burton upon Trent (GB)

( * ) Notice: Subject to any disclaimer, the term of this patent is extended or adjusted under 35 U.S.C. 154(b) by 0 days.

(21) Appl. No.: 15/888,772

(22) Filed: Feb. 5, 2018

(65) Prior Publication Data

US 2018/0230704 A1 Aug. 16, 2018

(30) Foreign Application Priority Data

Feb. 14, 2017 (GB) ..... 1702356

(51) Int. Cl.

| | |
|---|---|
| ***E04G 21/32*** | (2006.01) |
| *E04G 5/14* | (2006.01) |
| *A47B 57/50* | (2006.01) |
| *A47B 57/22* | (2006.01) |

(52) U.S. Cl.

CPC ..... *E04G 21/3223* (2013.01); *E04G 21/3247* (2013.01); *A47B 57/22* (2013.01); *A47B 57/50* (2013.01); *E04G 5/14* (2013.01)

(58) Field of Classification Search

CPC ..... E04G 21/3223; E04G 21/3247; E04G 2001/155; A47B 57/22; A47B 57/50

See application file for complete search history.

(56) References Cited

U.S. PATENT DOCUMENTS

| | | | | | |
|---|---|---|---|---|---|
| 865,404 | A * | 9/1907 | Laurent | E05D 15/58 | 160/211 |
| 2,351,570 | A * | 6/1944 | Williams | E06B 9/52 | 160/228 |
| 3,055,462 | A * | 9/1962 | Steele | A47B 57/50 | 211/191 |

(Continued)

FOREIGN PATENT DOCUMENTS

| | | | |
|---|---|---|---|
| EP | 0 747604 | A1 | 12/1996 |
| FR | 2993594 | A1 | 1/2014 |

(Continued)

*Primary Examiner* — Adriana Figueroa
(74) *Attorney, Agent, or Firm* — Craft Chu PLLC; Andrew W. Chu

(57) ABSTRACT

A fixing device for a safety screen includes a bracket, a support member and a locking member. The support member includes a plurality of openings, and two of the openings include keyhole slots that are spaced from one another along the support member. Each of the keyhole slots include an enlarged portion and a slot. The bracket includes at least one engagement member that has a shank portion and a head. The head is receivable through the enlarged portion thereof. The shank portion is receivable by the slot of any of the keyhole slots, and the locking member is attached to the bracket. The bracket is engageable with the support member by inserting the head through the enlarged portion. The locking member is engageable with the support member following translational movement of the engagement member along the slot, the locking member thereby locking the engagement member against translational movement.

20 Claims, 5 Drawing Sheets

(56) References Cited

U.S. PATENT DOCUMENTS 3,219,157 A * 11/1965 Gordon ..... A47B 57/50 403/108
3,303,937 A * 2/1967 McConnell ..... A47B 57/50 211/187
3,346,126 A * 10/1967 Bloom ..... A47B 57/487 211/192
3,392,848 A * 7/1968 McConnell ..... A47B 57/50 211/192
3,612,290 A * 10/1971 Evans ..... A47B 57/50 211/187
3,702,137 A * 11/1972 Evans ..... A47B 57/487 108/144.11
3,848,854 A * 11/1974 De Barbieri ..... E04G 5/142 256/70
3,905,712 A * 9/1975 McConnell ..... A47B 57/487 403/317
3,986,318 A * 10/1976 McConnell ..... F16B 12/34 403/384
4,106,630 A * 8/1978 Rosenband ..... A47B 57/22 211/191
4,635,699 A * 1/1987 Kauffman ..... B23Q 11/0825 160/211
4,955,743 A * 9/1990 King ..... A47B 57/50 403/254
5,025,937 A * 6/1991 King ..... A47B 57/22 211/192
5,241,789 A * 9/1993 Vacelet ..... E04G 21/3223 49/248
5,624,045 A * 4/1997 Highsmith ..... A47B 57/487 211/191
5,791,502 A * 8/1998 Bietz ..... A47B 57/50 211/192
5,845,795 A * 12/1998 Mulholland ..... A47B 47/027 211/192
5,938,367 A 8/1999 Olson
6,230,910 B1 * 5/2001 Olsson ..... A47B 57/50 211/192
6,241,109 B1 * 6/2001 Kautz ..... A47B 57/50 211/192
6,679,393 B1 * 1/2004 Weaver ..... A47B 57/50 211/192
2001/0045404 A1 11/2001 Pellegrino
2005/0111912 A1 * 5/2005 Brain ..... A47B 57/50 403/353
2013/0168626 A1 * 7/2013 Blinn ..... E04G 21/3266 256/31
2014/0284294 A1 * 9/2014 Taylor ..... A47B 45/00 211/134
2015/0152658 A1 * 6/2015 Rosati ..... E04G 21/3247 182/222

FOREIGN PATENT DOCUMENTS

WO WO-2011002120 A1 * 1/2011 ..... E04G 3/28
WO 2016137339 A1 9/2016

* cited by examiner

SAFETY SCREEN COMPRISING A FIXING MEANS

CROSS-REFERENCE TO RELATED APPLICATIONS

See also Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present disclosure relates to a safety screen comprising a fixing means, in particular to such a safety screen that is useful as part of a climbing screen. It further relates to a climbing screen comprising the fixing means and to the fixing means itself.

2. Description of Related Art Including Information Disclosed Under 37 CFR 1.97 and 37 CFR 1.98.

In modern construction, particularly in the construction of high rise buildings it is common to have a central core, which houses lift shafts and stairs and which provides support to the floors of the construction, wherein the central core and floors are formed by poured concrete. Such structures commonly have no external walls. During large periods of construction therefore, the floors remain open at their edges. It is only when a façade is introduced that the perimeter of the building is enclosed. Such open floors cause numerous health and safety risks. Workers operating on the exposed floors of the construction are at risk of falling from the construction. Workers or members of the public on the ground are at risk from tools, equipment or debris falling from the exposed floors.

It is known to provide safety screens, which extend around at least a portion of the perimeter of constructions, which effectively provide a temporary façade. These safety screens are advantageously moveable vertically to protect the perimeter of any required floor as the construction progresses. Such screens are commonly referred to as "climbing screens". Movement of the climbing screens up the construction may be affected either by crane or by hydraulic lifting equipment located on floors of the construction.

These climbing screens typically comprise a climbing rail and a safety screen. The climbing rail is engaged, in use, by floor guides, which project outwardly from the edges of the floors. The floor guides allow translation of the climbing screen along the construction and are further operable to lock the position of the climbing screen adjacent appropriate floors during use.

Climbing screens are bulky items when assembled. However, it is desirable that the climbing screens arrive on site at a construction in a fully or at least substantially assembled state. It is therefore beneficial if means are provided for reducing the size of an assembled climbing screen for transport. This may be accomplished by the provision of a safety screen comprising one or more fixed panels and one or more moveable panels. Such a safety screen will be configured to have a retracted state (for transport) and an extended state (in use), wherein each of the moveable panels will be adapted to at least partially overlap with one or more of the fixed panels in the retracted state and will be adapted such that in the extended state the degree of overlap is less than in the retracted state.

There is typically a gap formed between the safety screen of the climbing screen and the peripheral edge of each of floors closed off by the climbing screen. To avoid the risk of objects falling to the ground via these gaps, it is common to provide one or more pivotally mounted panels (typically comprising plywood sheets) for closing off the gaps between one or two of the floors and the safety screen. In use, for closing off a gap, a respective panel will be pivoted downwardly to abut a respective floor and lie at an angle to the horizontal, such that any falling items will strike the panel and be deflected into the construction.

It is necessary to provide mounting means for the pivotal panels. Typically, to allow for extension of the climbing screen a form of telescoping rail is provided. Problems have arisen, however, with the fixing of the telescoping rail arrangement to the sliding outer panels of the climbing screen. Firstly, it is highly preferable to allow for the adjustment of the height of the telescoping rail arrangement when the climbing screen is in situ. Secondly, it is highly desirable that the sliding outer panels of transversely adjacent climbing screens may be brought together to prevent the creation of gaps therebetween.

BRIEF SUMMARY OF THE INVENTION

The present invention arose in a bid to provide an improved fixing means, in particular, a fixing means suitable for solving the abovementioned problems.

According to the present invention in a first aspect, there is provided a safety screen comprising a fixing means, a rail and a pivotally mounted panel, the fixing means comprising a bracket, a support member and a locking member, the support member comprising a plurality of openings, at least two of the openings comprising keyhole slots that are spaced from one another along the support member, each of the keyhole slots comprising an enlarged portion and a slot, the enlarged portion having a greater width dimension than the slot and being interconnected with the slot, the bracket comprising at least one engagement member that comprises a shank portion and a head, the head is sized so that it has a width greater than the slot of any of the keyhole slots but is receivable through the enlarged portion thereof, and the shank portion is sized to be receivable by the slot of any of the keyhole slots, and the locking member is attached to the bracket, wherein the bracket is engageable with the support member by inserting the head of the engagement member through the enlarged portion of one of the keyhole slots and translating the engagement member along the slot with the shank portion received thereby, and the locking member is engageable with one of the openings in the support member following translational movement of the engagement member along the slot, the locking member thereby locking the engagement member against translational movement, and wherein the bracket supports the rail and the rail supports the pivotally mounted panel.

According to the present invention in a further aspect, there is provided a climbing screen comprising the safety screen as defined above.

Further, preferred, features are presented in the dependent claims.

According to a yet further aspect, there is provided a fixing means comprising a bracket, a support member and a locking member, the support member comprising a plurality of openings, at least two of the openings comprising keyhole slots that are spaced from one another along the support member, each of the keyhole slots comprising an enlarged portion and a slot, the enlarged portion having a greater width dimension than the slot and being interconnected with the slot, the bracket comprising at least one engagement member that comprises a shank portion and a head, the head is sized so that it has a width greater than the slot of any of the keyhole slots but is receivable through the enlarged portion thereof, and the shank portion is sized to be receivable by the slot of any of the keyhole slots, and the locking member is attached to the bracket, wherein the bracket is engageable with the support member by inserting the head of the engagement member through the enlarged portion of one of the keyhole slots and translating the engagement member along the slot with the shank portion received thereby, and the locking member is engageable with one of the openings in the support member following translational movement of the engagement member along the slot, the locking member thereby locking the engagement member against translational movement.

BRIEF DESCRIPTION OF THE SEVERAL VIEWS OF THE DRAWINGS

Non-limiting embodiments will now be described, by way of example only, with reference to the accompanying drawings.

DETAILED DESCRIPTION OF THE INVENTION

Figure 1:
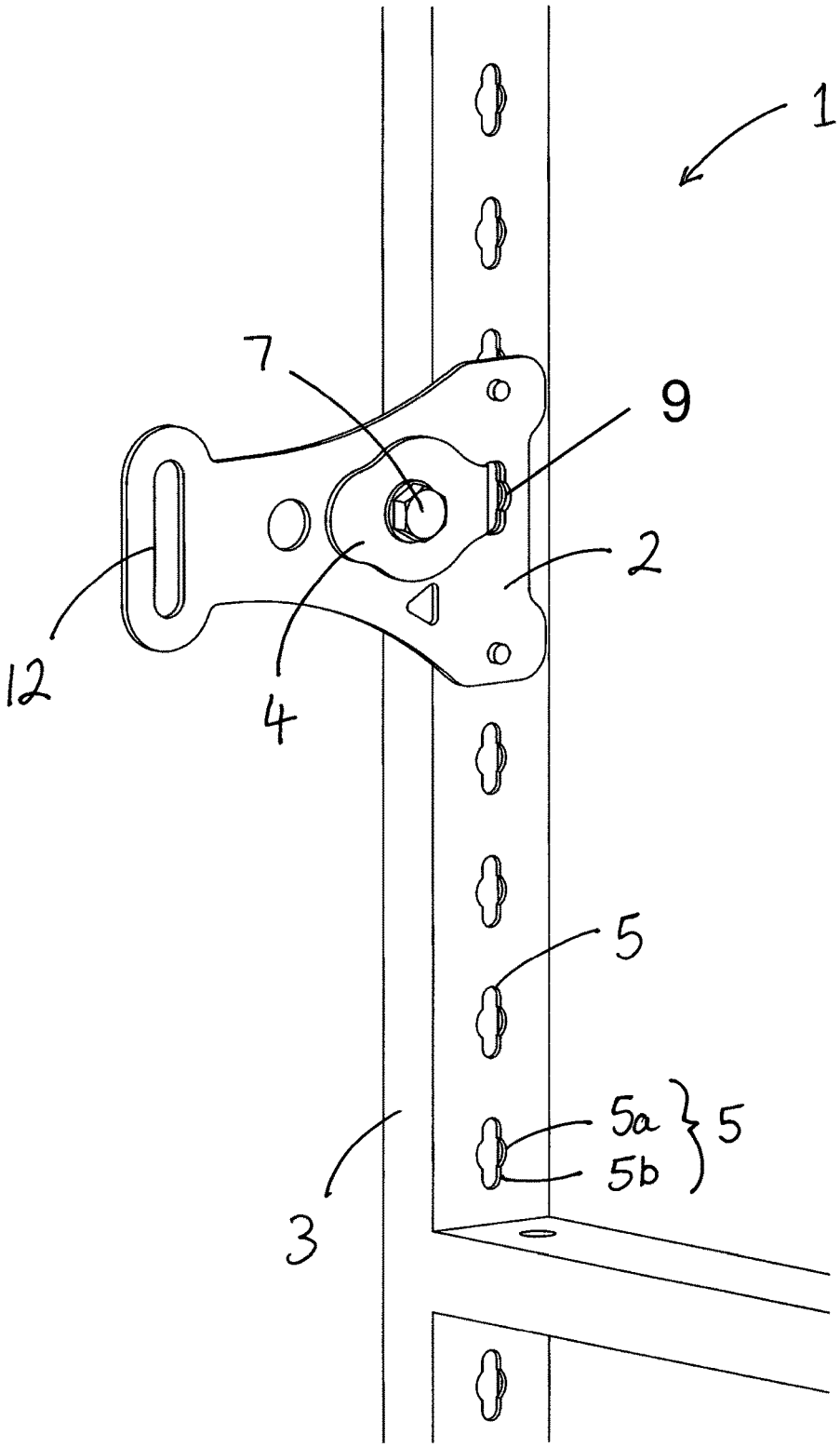
FIG. 1 shows a perspective view of a fixing means in accordance with an exemplary embodiment of the present invention.

With reference to the figures, there is shown a fixing means 1 comprising a bracket 2, a support member 3 and a locking member 4.

The support member 3 comprises a plurality of openings. The openings comprise keyhole slots 5 that are spaced from one another along the support member. Each of the keyhole slots comprises an enlarged portion 5*a* and a slot 5*b*, wherein the enlarged portion has a greater width dimension than the slot and is interconnected with the slot.

It should be noted that the plurality of openings may comprise the keyhole slots and one or more additional openings that do not comprise keyhole slots. In particular, whilst it is preferable that the locking member engages one of the keyhole slots, in alternative arrangements, as mentioned below, the locking member may be differently formed and engage an opening that does not comprise a keyhole slot.

Figure 4:
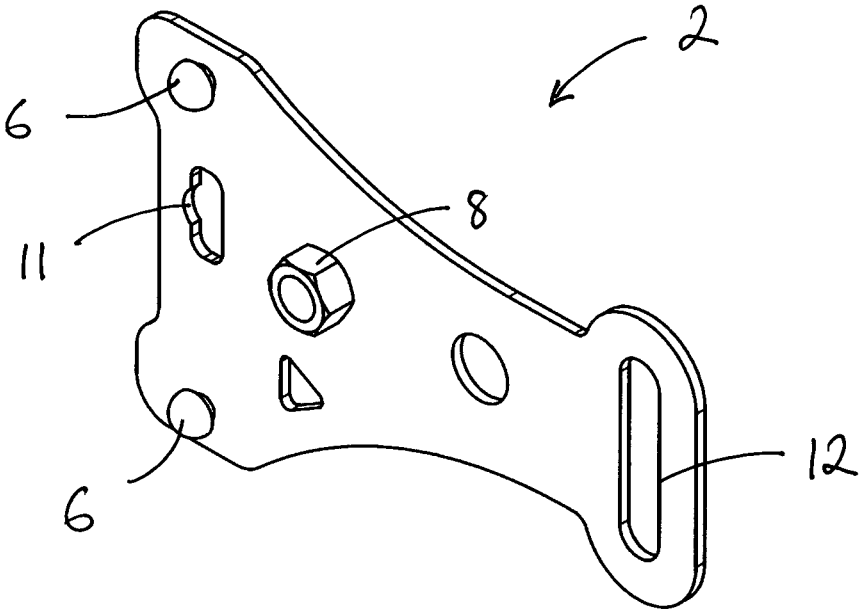
FIG. 4 shows a perspective view of the bracket of the fixing means of FIG. 1.
Figure 5:
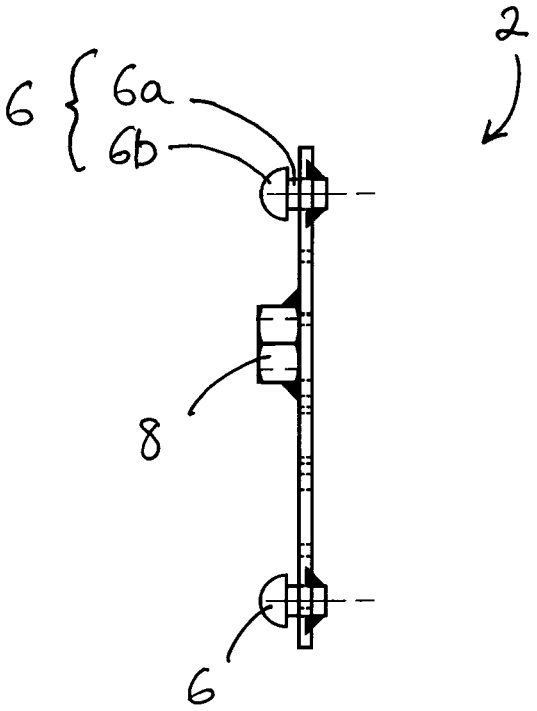
FIG. 5 shows an end view of the bracket of FIG. 4.

The bracket 2 comprises at least one engagement member 6 that comprises a shank portion 6*a* and a head 6*b* (as seen most clearly in FIGS. 4 and 5). The head 6*b* is sized so that it has a width greater than the slot 5*b* of any of the keyhole slots but is receivable through the enlarged portion 5*a* thereof. The shank portion 6*a* is sized to be receivable by the slot 5*b* of any of the keyhole slots.

It is preferable that two engagement members are provided, as shown. Arrangements may be provided, however, that comprise a single engagement member or that comprise three or more engagement members.

The bracket of the present arrangement is substantially planar, as seen. It may be formed from a plate. This is preferable for the reason that providing a light and low-profile bracket is desirable. It should be appreciated, however, that the fixing means may be implemented with a bracket taking any of numerous alternative forms, as will be readily appreciated by those skilled in the art. The bracket is provided with an opening 12 for attachment of any element that is to be supported by the fixing means. In the present arrangement, the opening 12 takes the form of a slot, which allows for a degree of adjustment. The slot extends vertically in use. As discussed below, the slot may be used for the attachment of a rail 16.

The bracket 2 is engageable with the support member 3 by simultaneously inserting the heads 6*b* of the engagement members 6 through the enlarged portions 5*a* of two of the keyhole slots and translating the engagement members 6 along the slots 5*b* with the shank portions 6*a* received thereby. The two engagement members are spaced from one another such that the engagement members simultaneously engage different keyhole slots to one another. In the present arrangement, the keyhole slots that are simultaneously engaged are not adjacent to one another. As discussed below, the locking member engages an intervening keyhole slot. In alternative arrangements, however, they may be adjacent to one another.

The locking member 4 is attached to the bracket 2. The attachment of the locking member to the bracket is such that the locking member remains attached to the bracket at all times during the use of the fixing means, including during attachment, detachment and adjustment operations of the bracket to/from/with respect to the support member. This is an important feature, which prevents the introduction of loose parts that may drop from the fixing means. In the present arrangement, the locking member is attached to the bracket with a bolt 7. The bolt engages a threaded opening in the locking member. Whilst the threaded opening may be provided in numerous ways, in the present arrangement it is provided by a permanently attached bolt 8, which is fixed to the bracket by welding. The locking member 4 may be engaged and disengaged by the tightening or loosening of the bolt, respectively. Means are implemented that prevent removal of the bolt and thereby ensure permanent attachment of the locking means to the bracket. Such means may, for example, comprise an element attached, by welding or otherwise to the end of the bolt or more simply predetermined damage to the thread of the bolt at its end. Various alternative arrangements will be readily appreciated by those skilled in the art, in addition.

The locking member 4 is engageable with one of the keyhole slots in the support member following translational movement of the engagement member 6 along the slot 5*b*, the locking member 4 thereby locking the engagement member against translational movement. The locking member, as mentioned, engages a keyhole slot that lies between the keyhole slots that are engaged by the engagement members 6. The bracket could, however, be configured so that a different keyhole slot was engaged, or so that an opening not forming a keyhole slot was engaged.

Figure 6:
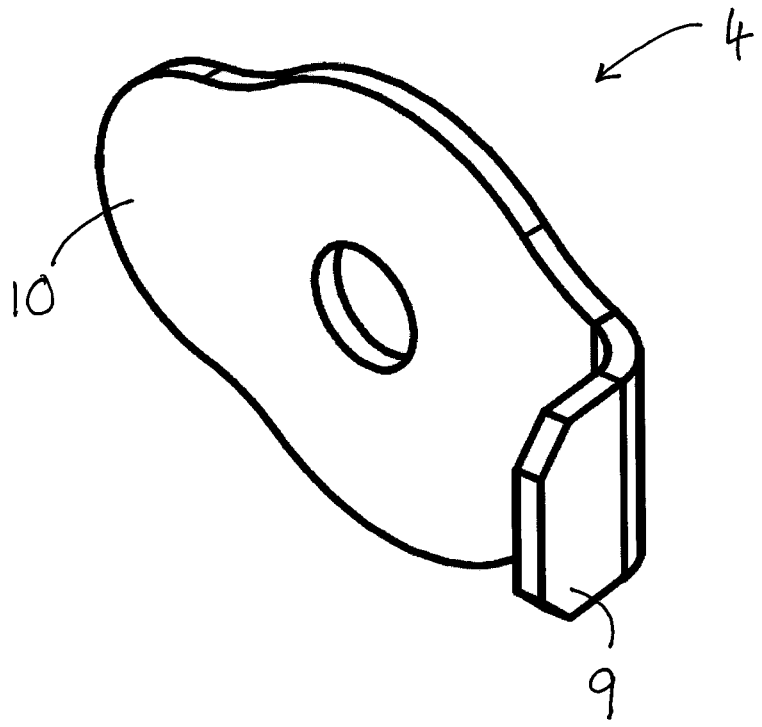
FIG. 6 shows a perspective view of the locking member of the fixing means of FIG. 1.
Figure 7:
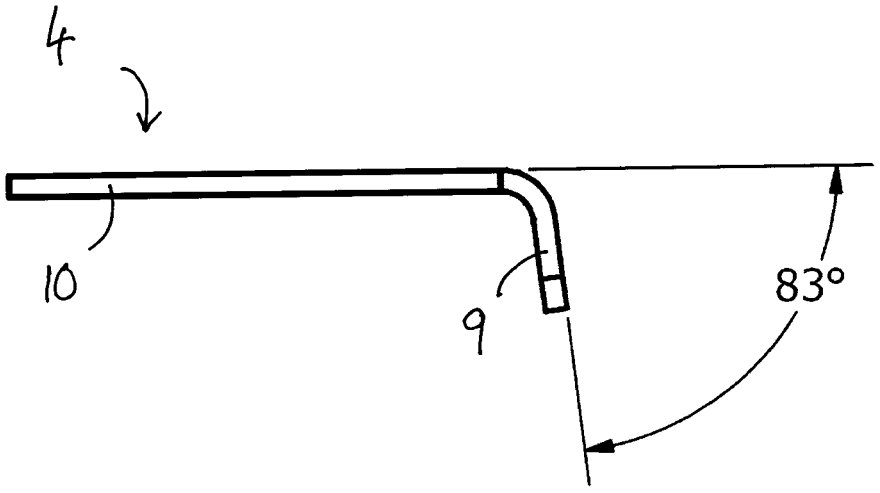
FIG. 7 shows a side view of the locking member of FIG. 6.

The locking member is best seen in FIGS. 6 and 7. It comprises a portion 9 that is received by the keyhole slot and has a dimension substantially equal to the length of the slot of the keyhole slot. The portion 9 passes through an opening 11 in the bracket, which has a length dimension substantially equal to the length of each of the keyhole slots that may receive the portion 9. The opening 11 is offset (vertically in use) to lie closer to the upper engagement member than the lower engagement member such that following translation of the engagement members along the slots (vertically downward), it is brought into alignment with the intervening keyhole slot.

The locking member in the present arrangement takes the form of a plate that comprises a body portion 10 and a tab 9, wherein the tab defines the portion 9 of the locking member that passes through the opening 11 and is received by the keyhole slot. It should be appreciated, however, that the locking member need not be limited to such an arrangement. The body portion 10 is clamped against the bracket 2 by tightening the bolt 7. Loosening the bolt allows for sufficient clearance for release of the tab 9 from any keyhole slot that it is received by when the fixing means is locked.

The tab 9 may lie substantially perpendicular to the body portion 10. It is, however, most preferable that it lies at an obtuse angle to the body portion of the plate. In the present arrangement it is arranged at an angle of 97° to the body portion. Of course this angle may vary and need not be particularly close to perpendicular, as will be appreciated by those skilled in the art. The benefit of the obtuse angle is that a wedging action may be introduced to add stability/rigidity to the bracket, removing any looseness in the attachment that may otherwise exist.

As has been discussed, the locking member need not be limited to the form shown. Numerous forms of locking member that are attached to the bracket and can act to prevent translation will be readily appreciated by those skilled in the art. For example, an arrangement comprising a tethered or spring-loaded pin or catch could be implemented, for receipt by the keyhole slots or by additional openings provided specifically for this purpose. Notably such additional openings could be provided in the same face of the support member as the keyhole slots or could be provided in a different face thereof.

The keyhole slots are all spaced from one another and provided in axial alignment. This allows for a simple arrangement, particularly where the locking means is adapted to engage the keyhole slots. It should be noted that the keyhole slots are not limited to the form shown. For example, whilst the enlarged portion of each of the keyhole slots is provided in a longitudinal mid-portion of the slot, it may alternatively be provided at an end of the slot, in the manner of a conventional keyhole. Moreover, whilst the enlarged portions are substantially circular, they could take any alternative shape such as square, for example, in which case the heads and/or shanks of the engagement members may be adapted in form accordingly.

The support member 3 may comprises a substantially planar face in which the keyhole slots are formed, as seen in FIG. 1. The support member is preferably hollow, forming a square or rectangular tube. It should be appreciated, however, that alternative support member structures are possible, including profiled beams, planar members or otherwise.

Figure 2:
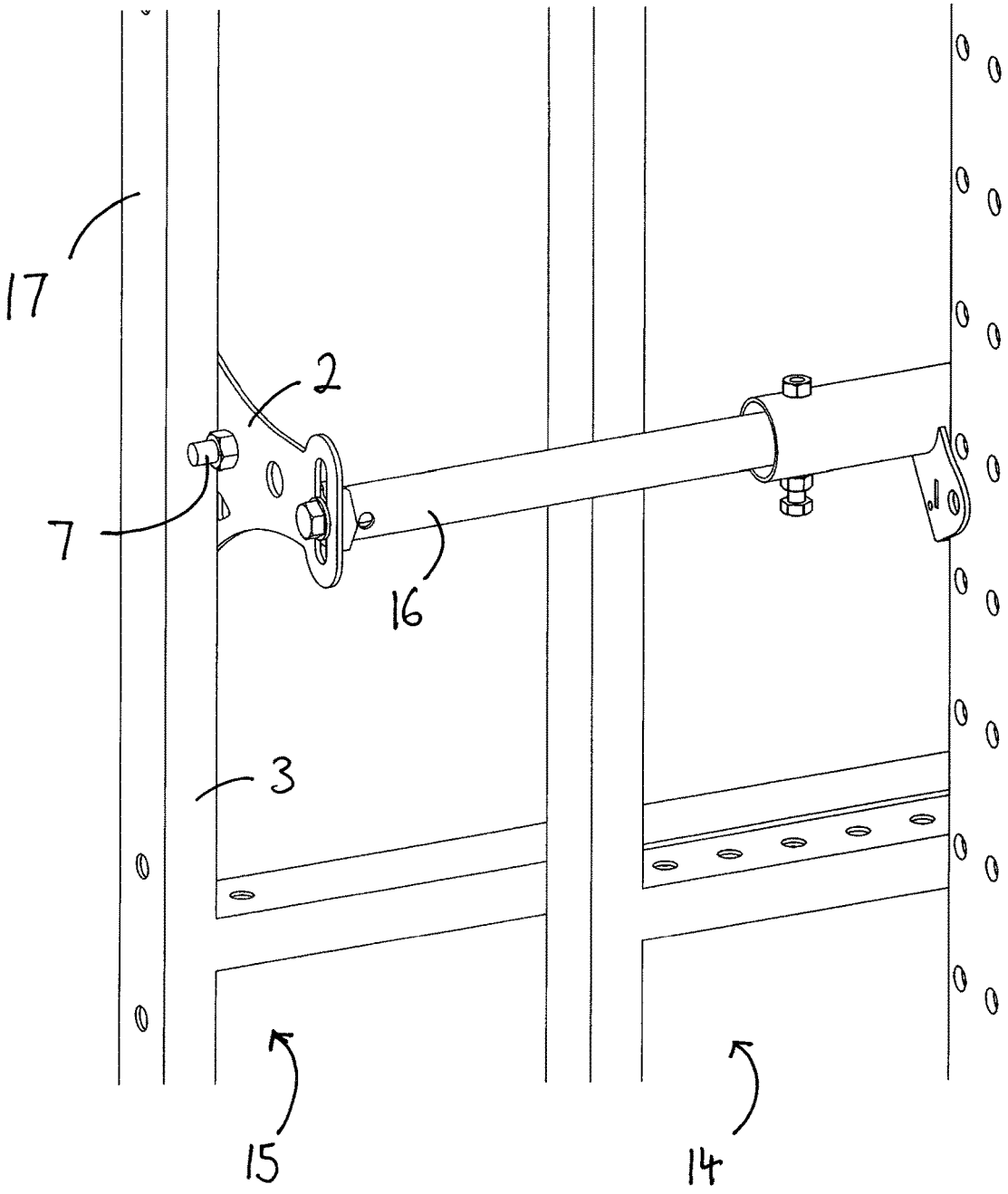
FIG. 2 shows a partial perspective view of a climbing screen comprising the fixing means of FIG. 1.

The support member preferably comprises a frame element of the safety screen. This is precisely the arrangement shown in FIGS. 1 and 2, wherein FIG. 1 shows a partial close up view of safety screen for a climbing screen, FIG. 2 shows a zoomed out partial view of the climbing screen 25 comprising the safety screen 14,15, and FIG. 3 shows a partial view of the climbing screen 25 in situ adjacent a floor 20 of a construction.

The safety screen comprises a fixed panel 14 and a moveable panel 15, wherein the safety screen is configured to have a retracted state and an extended state, wherein the moveable panel is adapted to at least partially overlap with the fixed panel in the retracted state and is adapted such that in the extended state the degree of overlap is less than in the retracted state or there is no overlap, and wherein the support member 3 comprises a frame element of the moveable panel, which extends vertically in use. The fixed and moveable panels will be provided with rigid or flexible mesh or perforated sheets 18 attached thereto, as seen in FIG. 3.

Figure 3:
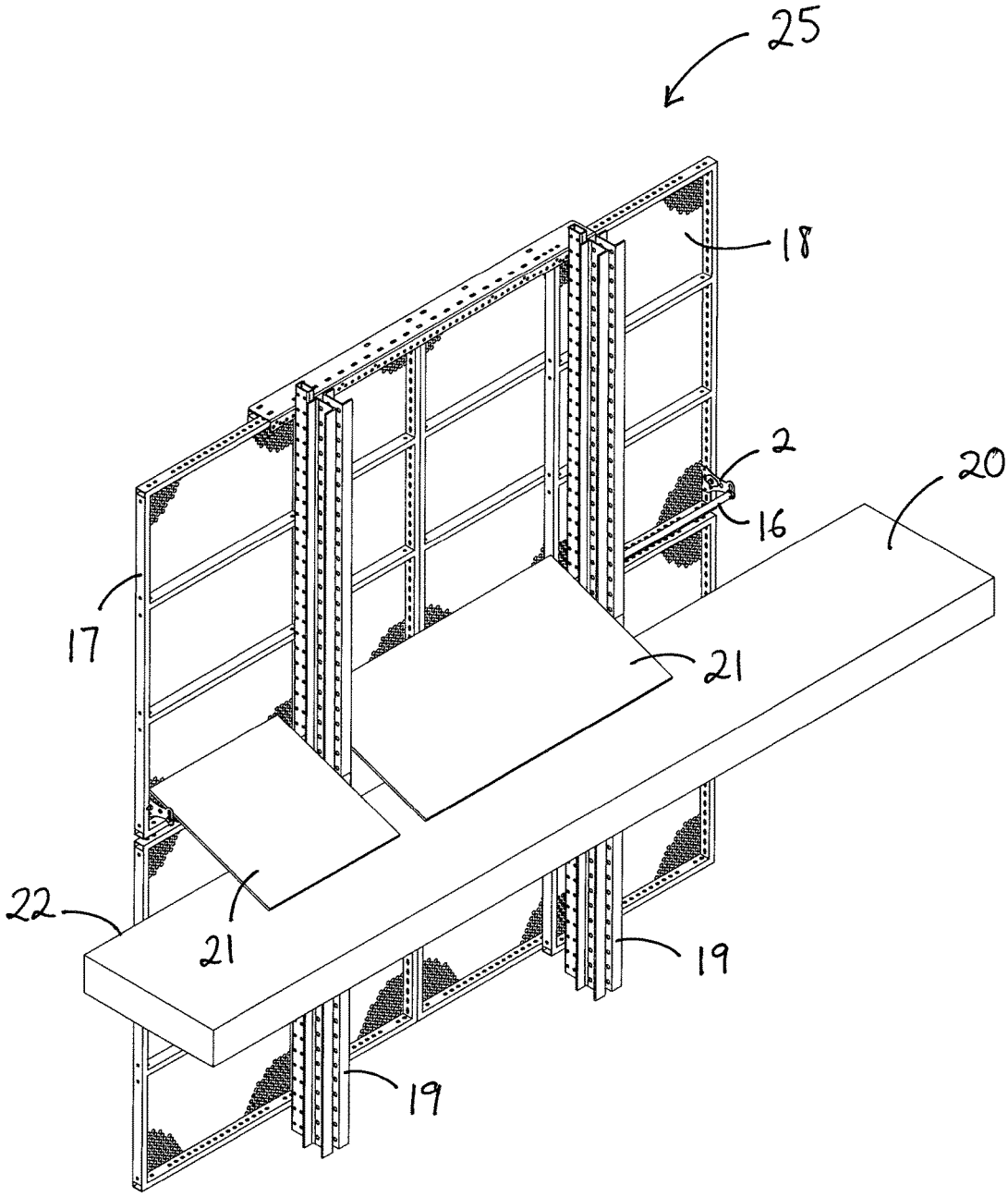
FIG. 3 shows a partial perspective view of a climbing screen in an in use configuration adjacent a floor slab of a construction.

In use, climbing rails 19 of the climbing screen, as seen in FIG. 3, will be supported by floor guides (not shown) that are fixed to the edges of the floors 20. A number of climbing screens will be provided alongside one another to close off of the perimeter of the construction.

The bracket supports a rail 16 for supporting a pivotally mounted panel 21, which can be used to close off gaps between the safety screen 14, 15 and the edge 22 of the floor 20 of the construction, as discussed in the introductory portion of the description above. The rail 16 preferably forms part of a telescopic rail that is extendable with the safety screen, as seen in FIG. 2.

It is preferable that the frame element 3 is an outermost element of the moveable panel 15 in an extension direction of the safety screen, as clearly seen in FIGS. 1 and 2. In such a case, the keyhole slots are preferably formed on a (transverse) inner face of the frame element 3. By such an arrangement, an outermost portion of the frame element (defined in the present arrangement by the transverse outer face 17) is unobstructed by any fixing means for the bracket 2. The result of this is that the transverse outer face may be brought into abutment with an opposed transverse outer face of the moveable panel of the adjacent climbing screen and any gap between the outermost frame elements of these climbing screens (and thereby the safety screens of these climbing screens) may be eliminated, whilst at the same time the pivotally mounted panels 21 may extend substantially gaplessly around the perimeter of the construction.

The fixing means may be modified in numerous ways, within the scope of the claims that follow, as will be readily appreciated by those skilled in the art.

I claim:

1. A safety screen, comprising:

a fixing means, being comprised of a bracket, a support member and a locking member;

a rail, having a rail longitudinal axis and being removably attached to said bracket; and a panel being planar and pivotally mounted to said rail, said panel extending downward from said rail at an angle, wherein said support member comprises a plurality of openings, at least two of the openings comprising keyhole slots spaced from one another along said support member, each keyhole slot comprising an enlarged portion and a slot, said enlarged portion having a greater width dimension than said slot and being interconnected with said slot, wherein said bracket comprises at least one engagement member, said bracket being substantially planar, each engagement member being comprised of a shank portion and a head, said head having a width greater than a respective slot of a respective keyhole slot and cooperative with a respective enlarged portion of said respective keyhole slot to as to be receivable through said respective enlarged portion, said shank portion having a width cooperative with said respective slot of said respective keyhole slot so as to be receivable through said respective slot, wherein said locking member is attached to said bracket, wherein said bracket is removably engaged with said support member, a respective head of each engagement member being insertable through said respective enlarged portion of said respective keyhole slot in an initial position of said respective head relative to said respective enlarged portion of said respective keyhole slot, a respective shank portion of each engagement member being translatable along said respective slot of said respective keyhole slot to a locked position of said respective head relative to said respective slot of said respective keyhole slot, wherein said locking member is removably engaged with a corresponding opening in said support member with said respective head relative to said respective slot of said respective keyhole slot in said locked position so as to lock said engagement member against translational movement relative to said respective keyhole slot, and wherein said bracket supports said rail relative to said support member and said panel relative to said support member.

2. The safety screen of claim 1, wherein said bracket comprises at least another engagement member spaced from said at least one engagement member, said at least one engagement member and said at least another engagement member having respective keyhole slots.

3. The safety screen of claim 1, wherein said corresponding opening is comprised of another keyhole slot.

4. The safety screen as claimed in claim 3, wherein said locking member comprises a plate with a length cooperative with said another keyhole slot so as to lock said locking member relative to said bracket and said support member.

5. The safety screen as claimed in claim 4, wherein said plate comprises a body portion and a tab, said tab being cooperative with said another keyhole slot.

6. The safety screen as claimed in claim 5, wherein said tab is arranged at an obtuse angle to said body portion of said plate.

7. The safety screen as claimed in claim 1, wherein each slot of each keyhole slot is axially aligned with one another.

8. The safety screen as claimed in claim 1, wherein each enlarged portion of each keyhole slot is provided at an end of said keyhole slot.

9. The safety screen as claimed in claim 1, wherein said support member is comprised of a planar face, said keyhole slots being formed in said planar face.

10. The safety screen as claimed in claim 1, wherein said support member is hollow.

11. The safety screen as claimed in claim 1, wherein said support member comprises a square tube.

12. The safety screen as claimed in claim 1, wherein said support member comprises a frame element.

13. The safety screen as claimed in claim 1, further comprising:

a moveable panel mounted to said fixing means; and a fixed panel, said moveable panel at least partially overlapped with said fixed panel in a retracted state, said moveable panel being less overlapped with said fixed panel than said retracted state in an extended state, wherein said support member further comprises a frame element, said moveable panel being mounted to said frame element.

14. The safety screen as claimed in claim 13, wherein said frame element is outermost from said fixed panel in an extension direction in said extended state.

15. The safety screen as claimed in claim 13, wherein said frame element has an inner face, said keyhole slots being formed on said inner face.

16. The safety screen as claimed in claim 1, wherein said rail is telescopic.

17. The safety screen as claimed in claim 1, further comprising:

a climbing rail positioned relative to said support member so as to form a climbing screen.

18. The safety screen as claimed in claim 1, wherein each enlarged portion of each keyhole slot is provided at a midpoint of said keyhole slot.

19. The safety screen as claimed in claim 1, wherein said support member comprises a rectangular tube.

20. A safety screen, comprising:

a fixing means, being comprised of a bracket, a support member and a locking member;

a rail, having a rail longitudinal axis and being removably attached to said bracket; and a panel being pivotally mounted to said rail, wherein said support member comprises a plurality of openings, at least two of the openings comprising keyhole slots spaced from one another along said support member, each keyhole slot comprising an enlarged portion and a slot, said enlarged portion having a greater width dimension than said slot and being interconnected with said slot, wherein said bracket comprises at least one engagement member, said bracket being substantially planar, each engagement member being comprised of a shank portion and a head, said head having a width greater than a respective slot of a respective keyhole slot and cooperative with a respective enlarged portion of said respective keyhole slot to as to be receivable through said respective enlarged portion, said shank portion having a width cooperative with said respective slot of said respective keyhole slot so as to be receivable through said respective slot, wherein said locking member is attached to said bracket, wherein said bracket is removably engaged with said support member, a respective head of each engagement member being insertable through said respective enlarged portion of said respective keyhole slot in an initial position of said respective head relative to said respective enlarged portion of said respective keyhole slot, a respective shank portion of each engagement member being translatable along said respective slot of said respective keyhole slot to a locked position of said respective head relative to said respective slot of said respective keyhole slot, wherein said locking member is removably engaged with a corresponding opening in said support member with said respective head relative to said respective slot of said respective keyhole slot in said locked position so as to lock said engagement member against translational movement relative to said respective keyhole slot, wherein said bracket supports said rail relative to said support member and said panel relative to said support member, and wherein said bracket has a planar surface, said rail longitudinal axis extending perpendicular to said planar surface.

* * * * *